United States Patent [19]

Benjamin et al.

[11] 4,033,232

[45] July 5, 1977

[54] CHARGE FORMING DEVICE

[75] Inventors: Benjamin C. Benjamin, Flint; Glenn A. Schautz, Lennon, both of Mich.

[73] Assignee: Schmelzer Corporation, Durand, Mich.

[22] Filed: Dec. 29, 1975

[21] Appl. No.: 645,084

Related U.S. Application Data

[62] Division of Ser. No. 507,128, Sept. 18, 1974, Pat. No. 3,965,223.

[52] U.S. Cl. ..... 91/47; 92/13.2; 92/13.6

[51] Int. Cl.[2] ..... F15B 13/042; F15B 15/24

[58] Field of Search ..... 92/99, 100, 13.2, 13.6, 92/94, 135; 91/47, 468; 261/39 B; 123/119 F

[56] References Cited

UNITED STATES PATENTS

| | | | |
|---|---|---|---|
| 2,015,374 | 9/1935 | Baker | 92/13.2 X |
| 2,043,983 | 6/1936 | Alder | 137/513.5 X |
| 2,985,196 | 5/1961 | Brunner | 92/99 X |
| 3,486,742 | 12/1969 | Szwargulski | 261/39 B |
| 3,502,000 | 3/1970 | Voges et al. | 91/47 |
| 3,606,983 | 9/1971 | Mitchell | 261/39 B |
| 3,773,023 | 11/1973 | Taylor | 261/39 B |
| 3,886,240 | 5/1975 | Baldwin et al. | 261/39 B |
| 3,886,241 | 5/1975 | Schubeck | 261/39 B |
| 3,931,830 | 1/1976 | Gritz | 137/513.5 |

*Primary Examiner*—Irwin C. Cohen
*Attorney, Agent, or Firm*—Fisher, Gerhardt & Groh

[57] ABSTRACT

A carburetor has a vacuum operated diaphragm type choke control device that acts in connection with a thermostatic control to permit the carburetor choke valve to be closed during starting but provides a controlled gradual opening of the choke valve after starting. An adjustable stop member permits adjustment of the opening by limiting the extent of movement of the diaphragm. The device includes purge feature for continual self-cleaning of the device. A one-way check valve device and precision by-pass means give exact control of the choke opening.

4 Claims, 4 Drawing Figures

CHARGE FORMING DEVICE

This is a division of application Ser. No. 507,128, filed Sept. 18, 1974, now U.S. Pat. No. 3,965,223.

The present invention relates to charge forming devices for internal combustion engines and more particularly to control means for opening the choke valve after the engine is started.

In order to prevent stalling of an engine after it has been started in cold weather it is desirable to partially open the automatic choke valve which must be fully closed by a thermostatic device in order to provide an air-fuel mixture that is rich enough to enable the engine to start. Once started, a leaner air-fuel mixture is desirable to prevent stalling and for efficient and smooth engine operation. In order to open the choke valve it has been proposed to provide a vacuum operated device that will overpower the thermostatic device that acts to control the choke valve position in response to changes in engine temperature.

It may also be desirable to gradually open the choke valve even further to obtain a leaner air-fuel mixture in order to prevent engine loading and provide reduced exhaust emissions. Such a desirable choke control should not only provide an accurately controlled rate of opening but permit a rapid closing when the vacuum suddenly drops as when the throttle is rapidly opened and the engine accelerated. The device should not be subject to malfunction due to fuel vapors or dirt entering the device. Because of the varying applications that a vacuum operated choke control device has, including different carburetors, different engines etc, it is also desirable to provide means for adjusting the device so as to permit one device to be usuable in such varying applications.

It is an object of the present invention to provide an improved vacuum operated choke control device in combination with a charge forming device particularly a carburetor.

A further object is to provide such a vacuum device that has a precise control of the rate of operation in order to prevent the device from opening the choke valve prematurely or too rapidly thus stalling the engine prior to proper starting thereof.

Still another object is to provide adjustment means on the vacuum device to precisely set the length of stroke of the same without requiring special external linkage.

These and other objects and advantages will be readily apparent from the following description and accompanying drawings in which.

Figures 1, 3:
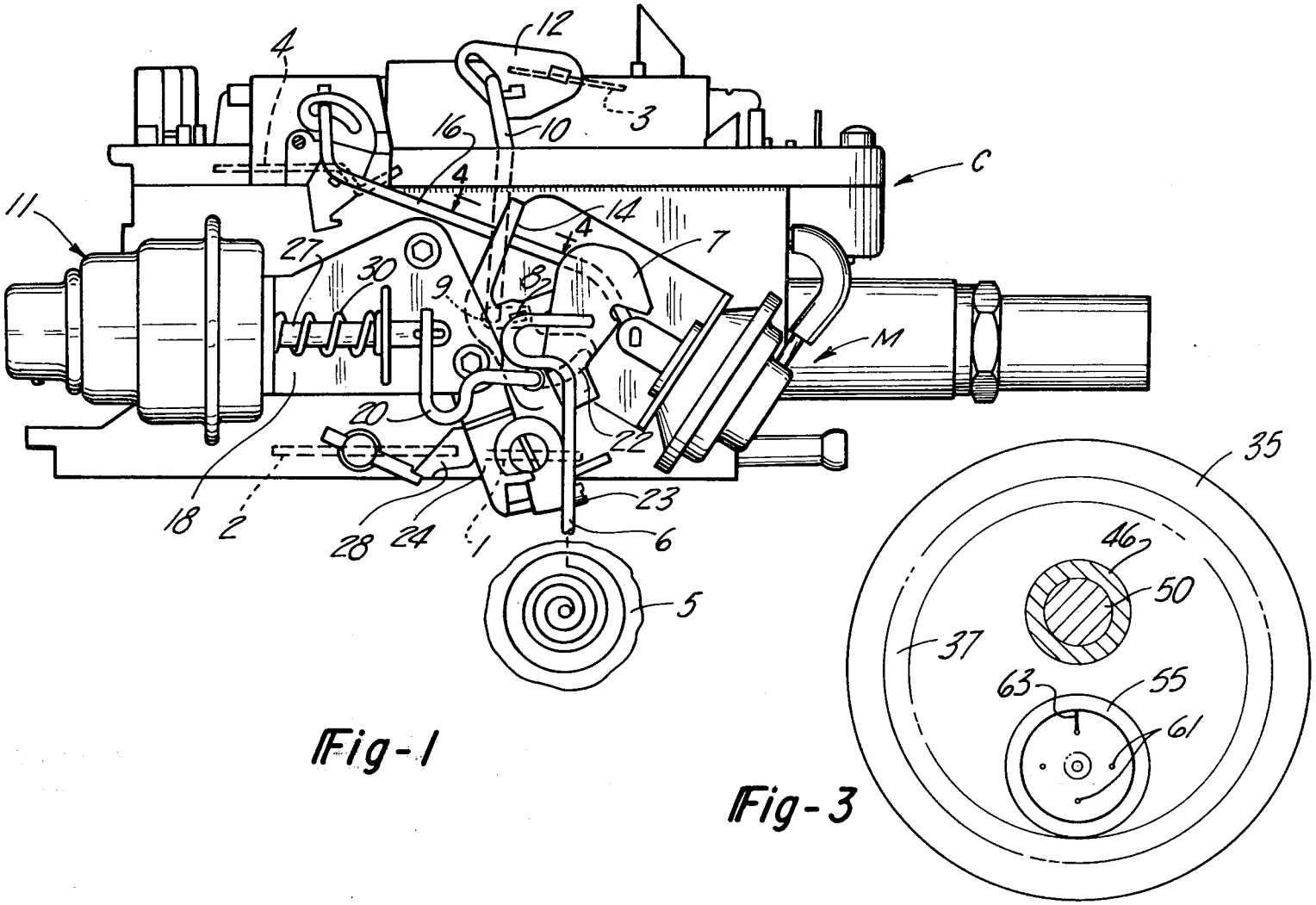
FIG. 1 is an elevational view of an engine carburetor incorporating the invention.
FIG. 3 is a sectional view taken on the line 3 of FIG. 2.
Figure 4:
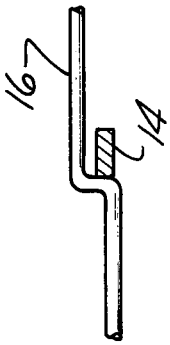
FIG. 4 is a sectional view taken on line 4—4 in FIG. 1.

The invention is shown applied to a conventional four barrel carburetor generally indicated in FIG. 1 as C and which includes a primary throttle valve 1 and a secondary throttle valve 2 each controlling the flow of air-fuel mixture into the intake manifold of the engine. The throttle valves 1 and 2 are operated by linkage on the opposite side of the carburetor. A conventional choke valve 3 acts to restrict air flow into the primary portion and air valve 4 restricts flow into the secondary portion. The air valve is conventionally operated by air pressure differential acting on the unbalanced areas of the air valve.

A thermostatic coil device 5 acts through a rod 6 having an end portion engaging a hole in a choke control lever 7 secured to a shaft 8 pivoted in the carburetor body. Inside the carburetor housing is a lever 9 secured to the shaft 8. A choke rod 10 engages a lost motion slot formed in a choke lever 12 secured to the shaft 14 on which the choke valve 3 is attached.

The choke control lever 7 has a tang portion 14 located in the path of a bent portion of a vacuum break rod 16. The rod 16 is connected at one end to a plunger and extending from a primary or main vacuum diaphragm device M supported on the carburetor and at the other end, engages into a lost motion slot formed in an air valve shaft lever 17 on which the air valve is attached.

A secondary vacuum break device, generally indicated 11, is also supported on the carburetor by a bracket 18. A plunger 27 has a slot in which one end of a secondary vacuum break rod 20 extends. The other end of the rod 20 engages in another lost motion slot 22 formed in an offset portion of the choke control lever 7. Rotatably mounted on the shaft 8 is a fast idle cam (not shown) which is actuated by another tang formed on the lever 7. A fast idle cam follower 24 is rotatable on the main throttle shaft and an adjusting screw 23 adjusts the relative position of the follower and the throttle shaft. The fast idle cam has a portion that activates a secondary throttle lockout lever 28 that engages a lock pin 29 on the throttle shaft to hold the same from being opened when the choke valve is closed.

Figure 2:
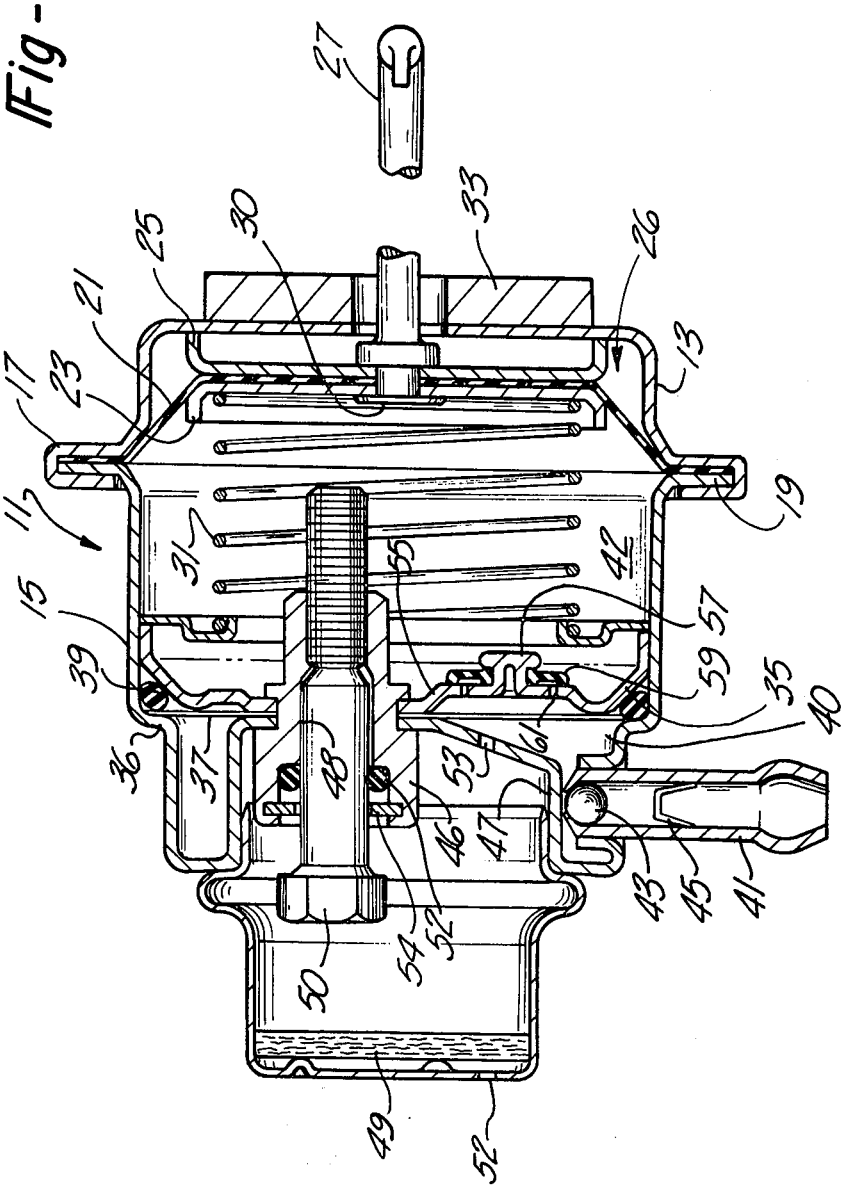
FIG. 2 is a cross-sectional view of the vacuum at an enlarged scale operated device.

The secondary vacuum responsive break device 11 is shown in detail in FIG. 2 and comprises a casing including a pair of cup-shaped members 13 and 15. The members 13 and 15 are secured together by a flange portion 17 on member 13 rolled over the peripheral edge 19 of member 15. A flexible diaphragm 21 is also secured by the clamping action of the flange portion 17.

Located on opposite sides of the diaphragm are cup-shaped elements 23 and 25 which act to provide a piston-like assembly 26 in combination with the diaphragm 21 and which also act as a stop to limit travel of the piston assembly to the right as seen in FIG. 2. The cup elements 23 and 25 are secured together by the flattened end 30′ on link 27. The piston assembly 26 is biased to the right as seen in FIG. 2 by a spring 31 having one end engaging the piston assembly inside of cup-shaped element 23 and its other end engaging an annular retainer abutting an annular flange on the wall 35. The link 27 passes through a guide 33 inserted through an opening in the casing member 13 and supporting bracket 18.

The left hand chamber is divided into subchambers 40 and 42 by a rigid wall assembly which includes a cup-shaped member 35 that nests inside of the casing member 15. The wall assembly also includes a filter element 37 sandwiched between the member 35 and the radially extending end flange portion 36 of the casing member 15. An O-ring seal 39 lies between the outer peripheral edges of the filter 37 and member 35 to prevent leakage between the subchamber 40 and the subchamber 42 except through valve control means described below.

The left hand casing member has an aperture into which a vacuum tube 41 is inserted. The vacuum tube carries therein a ball valve 43 that sears against the flared inner end of the tube. A spring clip retainer member 45 serves to prevent the ball valve from blocking the outer end of the tube 41. The tube 41 is designed to fit into a rubber tube that connects to a vacuum source, such as the intake manifold, that varies with engine speed.

At the area where the filter 37 is sandwiched between the member 35 and the casing member 15 these members have a co-axial aperture offset from the axial center of the device 11 and through which an insert 46 extends. The insert itself has a stepped bore 48 that is threaded to receive an adjusting stop bolt 50. An O-ring 52 provides a seal between the insert 46 and bolt 50. The seal 52 is held in place by a retainer 54. By removing the cap 41 access to the hex head on the bolt 50 can be made, to turn the bolt to cause it to move axially in or out. The end of the bolt 50 extending into the chamber 42 acts as a stop for movement of the piston assembly 26 to the left as view in FIG. 2.

The casing member 15 has a concave portion 47 that receives a filter retaining cup 41 that has an air inlet aperture 52. A filter element 49 is received in the cup 41. The concave portion 47 has an air inlet aperture 53. The apertures 52 and 53 permit a limited flow of filtered ambient air to continuously enter the chamber 40 particularly during movement of the piston assembly 26 by the spring 31.

The cup-shaped wall 35 serves as a valve retainer and includes an offset portion 55 having a further offset stem portion 57 that retains a flexible disc valve 59. The portions 55 and 57 are radially offset from the axis of the unit 11 on the side opposite to the adjusting bolt 50. As seen in FIG. 3, a plurality of holes 61 are spaced around the stem 57. During movement of the piston assembly to the right as view in FIG. 2, air can freely enter through the holes 61 past the valve 59. During movement to the left the valve closes off the holes with the exception of one hole which is connected by a narrow groove 63 formed on the surface of the offset portion 55 as seen in FIG. 3. The groove 63 can be formed by drawing a fine wire over the surface of portion 55.

OPERATION

During engine cranking, the choke valve 13 is held closed by the thermostatic coil 4 acting through rod 6, lever 7, shaft 8, levers 9 and 10 and lever 12. This restricts air flow through the carburetor to provide a rich starting mixture. When the engine starts and is running, manifold vacuum is applied to the main vacuum unit M and the secondary vacuum unit 11. The main or primary unit acts by pulling in rod 16 to move tang 14 and lever 7 sufficiently to open the choke valve enough to permit the engine to run without loading or stalling.

The secondary vacuum break unit operates with a time delay due to the restricted flow of air through the slot 63 to gradually over a period of several seconds open the choke a little further to prevent loading and provide reduced exhaust emissions.

The slot in the stem or plunger 27 along with the slot 22 in the lever 7 permit the lever 7 to be moved between choke closed and choke open positions by the thermostatic coil unit.

As seen in FIG. 1, the spring 30 acts between the vacuum unit 11 and a retainer 32 carried on the stem 27 to assist closing the choke when the engine is stopped and the thermostatic coil unit is cool enough to cause the choke to close.

The secondary vacuum unit 11 is operated by vacuum from any suitable source responsive to engine load and speed. This may be just below the throttle valve or in the engine manifold. The valve 43 prevents high pressure from a backfire from entering the vacuum unit to cause damage on the internal parts. This valve is not essential, but acts to protect the unit. When the engine starts the vacuum draws air from the chamber 42 through the slot 63 past the disc valve 59, through the filter 37 into the chamber 40 and past the ball 43. The resulting vacuum in chamber 42 acts on diaphragm 21 to pull it to the left against the spring 31 until it hits the bolt 50. The time for the diaphragm and connected stem 27 to stroke its full distance is normally between 8 and 16 seconds, an optimum time to gradually open the choke the additional amount dependent on the position of bolt 50 to obtain the leaner mixture that reduces emissions and at the same time prevents loading or stalling.

When the engine is stopped the vacuum in the intake manifold is gone and the spring 31 acts to move the diaphragm and stem to the right. This permits the choke valve to be set in a position totally dependent on the force of the thermostatic coil unit. As the diaphragm moves to the right, air is drawn in through aperture 52, filter 49, aperture 53, filter 37, holes 61 past valve 59 into chamber 42. This air is double filtered and acts to continuously purge the unit of any fuel vapors and dirt which may possibly enter the check bleed valve and disrupt proper operation of the same.

Since the holes 52 and 53 always expose the chamber 40 to the atmosphere, they must be such that at least one is small enough to restrict flow enough to allow the vacuum to reach a value sufficient to operate the unit. Since clean outside air is always entering the system through the filter 49, the system is being constantly cleaned.

Modifications and changes may be apparent to those skilled in the art and such changes are deemed to be within the scope of the invention which is limited only by the following claims:

The embodiments of the invention in which an exclusive property or privilege is claimed are defined as follows:

1. A vacuum responsive device comprising: a casing, a flexible diaphragm dividing the casing into two main chambers, resilient means urging the diaphragm to a first position, a rigid wall assembly separating one of the main chambers into first and second subchambers, at least one aperture in said rigid wall assembly, a valve member normally engaging said rigid assembly and closing said aperture against air flow from the first subchamber, bypass means permitting restricted fluid flow in either direction between said subchambers, a vacuum passage adapted to connect said second subchamber with a source of vacuum, a passage means adapted to connect said second subchamber with the atmosphere, the other of said main chambers being in communication with the atmosphere, adjusting means for limiting the extent of movement of the diaphragm toward a second position, said valve member being axially offset from the axial center of the device, said adjusting means comprising a stop member extending through said rigid wall assembly into said first subchamber for engagement with said diaphragm, said stop member also being axially offset from the axial center of the device on the opposite side from the valve member.

2. The combination of claim 1 wherein said stop member comprises a bolt member threaded through an insert member carried by and extending through said rigid wall assembly, and seal means between said insert and bolt member for preventing leakage of air between the bolt member and insert.

3. The combination of claim 1 wherein said casing includes a concave portion in which said stop member extends, a removable cap fitted into and closing said concave portion, a restricted aperture in said cap and a filter element in said cap for filtering air passing into said concave portion through said aperture, said concave portion being in communication with said second subchamber via port means.

4. The combination of claim 1 in which a filter element is disposed in the passage means connecting said second subchamber with the atmosphere.

* * * * *

UNITED STATES PATENT OFFICE

CERTIFICATE OF CORRECTION

Patent No. 4,033,232 Dated July 5, 1977

Inventor(s) Benjamin C. Benjamin et al.

It is certified that error appears in the above-identified patent and that said Letters Patent are hereby corrected as shown below:

Column 1, line 54, after "view" -- at an enlarged scale -- should be inserted.

same line, "at an" should be deleted.

line 55, "enlarged scale" should be deleted.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*